US007003824B2

(12) United States Patent
Roussy

(10) Patent No.: US 7,003,824 B2
(45) Date of Patent: Feb. 28, 2006

(54) BED WITH ANTI-RATTLE MECHANISM FOR A BED RAIL

(75) Inventor: George Joseph Roussy, London (CA)

(73) Assignee: Invacare Corporation, Elyria, OH (US)

( * ) Notice: Subject to any disclaimer, the term of this patent is extended or adjusted under 35 U.S.C. 154(b) by 0 days.

(21) Appl. No.: 10/677,561

(22) Filed: Oct. 3, 2003

(65) Prior Publication Data

US 2005/0071922 A1 Apr. 7, 2005

(51) Int. Cl.
*A47C 21/08* (2006.01)

(52) U.S. Cl. ..... 5/430

(58) Field of Classification Search ..... 5/424, 5/425, 428, 430, 426
See application file for complete search history.

(56) References Cited

U.S. PATENT DOCUMENTS

| | | | | |
|---|---|---|---|---|
| 2,763,014 | A * | 9/1956 | Luger | 5/426 |
| 2,904,799 | A * | 9/1959 | Berlin | 5/426 |
| 3,104,402 | A | 9/1963 | Johnson | |
| 3,125,769 | A * | 3/1964 | Black et al. | 5/430 |
| 3,604,024 | A * | 9/1971 | Polanski | 5/430 |
| 3,930,273 | A | 1/1976 | Stern | |
| 3,971,083 | A * | 7/1976 | Peterson | 5/430 |
| 4,022,502 | A * | 5/1977 | Smith et al. | 5/426 |
| 4,186,456 | A | 2/1980 | Huempfner | |
| 4,724,559 | A | 2/1988 | Bly et al. | |
| 4,811,436 | A | 3/1989 | Schwartz | |
| 5,020,169 | A | 6/1991 | Hamada et al. | |
| 5,038,430 | A | 8/1991 | Bly | |
| 5,044,025 | A * | 9/1991 | Hunsinger et al. | 5/424 |
| 5,216,768 | A | 6/1993 | Bodine et al. | |
| 5,394,580 | A * | 3/1995 | Foster et al. | 5/430 |
| 5,640,726 | A * | 6/1997 | Fichner-Rathus | 5/426 |
| 5,740,568 | A | 4/1998 | Elliott | |
| 6,058,531 | A | 5/2000 | Carroll | |
| 6,519,794 | B1 | 2/2003 | Aarestad et al. | |
| 2003/0093860 | A1 * | 5/2003 | Kramer et al. | 5/600 |

FOREIGN PATENT DOCUMENTS

JP 09206337 A 12/1998

* cited by examiner

*Primary Examiner*—Michael Safavi
(74) *Attorney, Agent, or Firm*—Calfee, Halter & Griswold LLP

(57) ABSTRACT

There is described a bed comprising a frame, a rail pivotally mounted on the frame and pivotable between a guardrail position and an open position, a distance between the frame and the rail when the rail is in the guardrail position, and a resilient element mounted on the frame or on the rail or on both the frame and the rail to fill the distance between the frame and the rail when the rail is in the guardrail position to thereby reduce rattling of the rail when the rail is in the guardrail position. The resilient element is preferably a resilient roller mounted on the frame, the roller engaging the rail when the rail is pivoted into the guardrail position.

13 Claims, 3 Drawing Sheets

BED WITH ANTI-RATTLE MECHANISM FOR A BED RAIL

FIELD OF THE INVENTION

The present invention relates to beds, in particular hospital and long-term care beds, having rails and to anti-rattle mechanisms for bed rails.

BACKGROUND OF THE INVENTION

A bed rail on a bed, for example a hospital or long-term care bed, is used in a so-called guardrail position (also called a closed position) to keep a person from falling out of the bed and then moved to an open position to allow the person to exit the bed. As such, the bed rail must be moved, for example rotated, from the guardrail position to the open position, or vice versa. In order to move the rail efficiently, it is usually necessary to design tolerance between the moving parts and other parts on the bed. Such tolerance may lead to rattling of the rail in the guardrail position and to noise generated therefrom. Such noise can be very annoying and intrusive, especially in a facility where the environment is intended to be as quiet as possible. Therefore, there is a need in the art to reduce rattling of bed rails, particularly on hospital and long-term care beds.

U.S. Pat. No. 3,930,273 issued Jan. 6, 1976 to Stern discloses the use of a spring washer to reduce vibration between parts of a rotatable rail assembly.

U.S. Pat. No. 4,186,456 issued Feb. 5, 1980 to Huempfner teaches the use of a tubular bushing fitted into an anchoring member to provide a smoother bearing surface for swivel action of a rail.

U.S. Pat. No. 5,020,169 issued Jun. 4, 1991 ti Hamada et al. discloses the use of a "supplemental member" to take up the tolerance between a plunger and a guide groove so that an engaging element can slide along a guide rail without vibrating or shaking.

U.S. Pat. No. 5,740,568 issued Apr. 21, 1998 to Elliott discloses a square bushing having a flexible finger for preventing rattling of the bushing in a slot.

U.S. Pat. No. 6,519,794 issued Feb. 18, 2003 to Aarestad et al. discloses that vibration of a side rail for a bed can be prevented by having a tapered lock pin hole in which a tapered lock pin sits tightly.

There remains a need for effective ways for controlling rattling of a bed rail on a bed.

SUMMARY OF THE INVENTION

According to an aspect of the invention, there is provided a bed comprising a frame, a rail pivotally mounted on the frame and pivotable between a guardrail position and an open position, a distance between the frame and the rail when the rail is in the guardrail position, and a resilient element mounted on the frame or on the rail or on both the frame and the rail to fill the distance between the frame and the rail when the rail is in the guardrail position to thereby reduce rattling of the rail when the rail is in the guardrail position.

According to another aspect of the present invention, there is provided an anti-rattle mechanism for a pivotable bed rail on a bed comprising a resilient element mounted on a frame of the bed to fill a distance between the frame and the rail when the rail is in a guardrail position.

Any suitable type of bed may be used in this invention. Hospital and long-term care beds are of particular note.

Any suitable type of rail that is pivotally mounted to a bed frame may be used in this invention. Rails may be mounted on any combination of sides and/or ends of the bed. Side rails are of particular note. The pivotally mounted rails may pivot in any direction, although rails which pivot through a plane perpendicular to the plane of the bed and parallel to the side of the bed are of particular note. Of particular note are side rails which have a guardrail position for preventing a person from falling out of the bed and which may be rotated to an open position for allowing a person to exit the bed. Examples of such rails are disclosed in U.S. Pat. Nos. 6,058,531; 5,216,768; 2,817,854 and 3,585,658.

A resilient element may be mounted on the frame or the rail, or, both the frame and the rail may have resilient elements mounted thereon. When the rail is in the guardrail position, the resilient element or elements fill the distance between the frame and the rail. The resilient element reduces rattling of the rail when the rail is in the guardrail position. The resilient element should be mounted on the frame (or the rail) in a location where the resilient element will engage the rail (or the frame) when the rail is moved to the guardrail position. For rails which are pivotally mounted on the frame at more than one point, there may be a resilient element located near or at each pivot point to fill the distance between the frame and the rail.

The resilient element may be made of any suitable resilient material, for example, natural or synthetic rubbers, elastomers, thermoplastic polymers, or combinations thereof. The resilient material is preferably deformable under pressure but will retain its original shape after the pressure is relieved. In this way, the resilient element can be designed to be somewhat larger than the distance between the frame and the rail but is sufficiently deformable to be forced to fit into the distance. The resilient element can then exert force on the rail and the frame due to its resiliency, to thereby help wedge the rail in position. This helps reduce rattling and helps prevent the rail from accidentally slipping out of position. One skilled in the art understands that the resilient elements may be formed of a core of non-resilient material having a resilient material affixed to a surface thereof.

In one embodiment, a resilient element is mounted on the frame. When the rail is moved from the open position to the guardrail position, the resilient element engages the rail, for example at a rail support, to fill the distance between the frame and the rail thereby wedging the rail in place to reduce rattling.

In another embodiment, a first resilient element is mounted on the frame and a second resilient element is mounted on the rail. When the rail is moved into the guardrail position the second resilient element frictionally engages the first resilient element, the two resilient elements together filling the distance between the frame and the rail. In the guardrail position, the second resilient element is compressibly held by the first resilient element to thereby reduce rattling of the rail.

The resilient element may be of any suitable shape. In one embodiment, the resilient element may be wedge-shaped. The thin edge of the wedge is the leading edge in respect of the rotation of the rail. Whether the wedge is mounted on the frame or the rail, as the rail is pivoted into the guardrail position, the thin edge of the wedge is the first part of the wedge-shaped resilient elements that occupies the distance between the rail and the frame. Once the rail is completely in the guardrail position, the large edge of the wedge is directly between the frame and the rail taking up the full distance and wedging the rail in place so that rattling of the rail is reduced. In this embodiment, the large edge of the wedge is slightly larger than the distance so that the wedge is compressed between the rail and the frame when the rail is in the guardrail position.

In another embodiment, the resilient element may be a roller mounted on the frame or the rail. The roller is preferably mounted on the frame and is mounted in a position that will fill the distance between the rail and the frame when the rail is in the guardrail position. The roller is oriented so that the plane in which the roller rotates is orthogonal to the plane in which the rail pivots at the guardrail position. Thus, if the rail pivots through a plane orthogonal to the plane of the bed and parallel to the side of the bed, then the roller rotates in a plane parallel with the plane of the bed and orthogonal to the side of the bed. In such an arrangement, as the rail is pivoted to the guardrail position, the rail will first engage the roller, the roller will begin to turn and the resilient material of the roller will begin to compress. Once the rail is fully in the guardrail position, the roller will have turned somewhat more and the resilient material of the roller will be compressed thus wedging the rail in place. The roller is preferably mounted to the frame by a mounting bracket. The roller preferably engages the rail at a rail support.

Further features of the invention will be described or will become apparent in the course of the following detailed description.

BRIEF DESCRIPTION OF THE DRAWINGS

In order that the invention may be more clearly understood, a preferred embodiment thereof will now be described in detail by way of example, with reference to the accompanying drawings, in which.

DESCRIPTION OF PREFERRED EMBODIMENT

Figure 1:
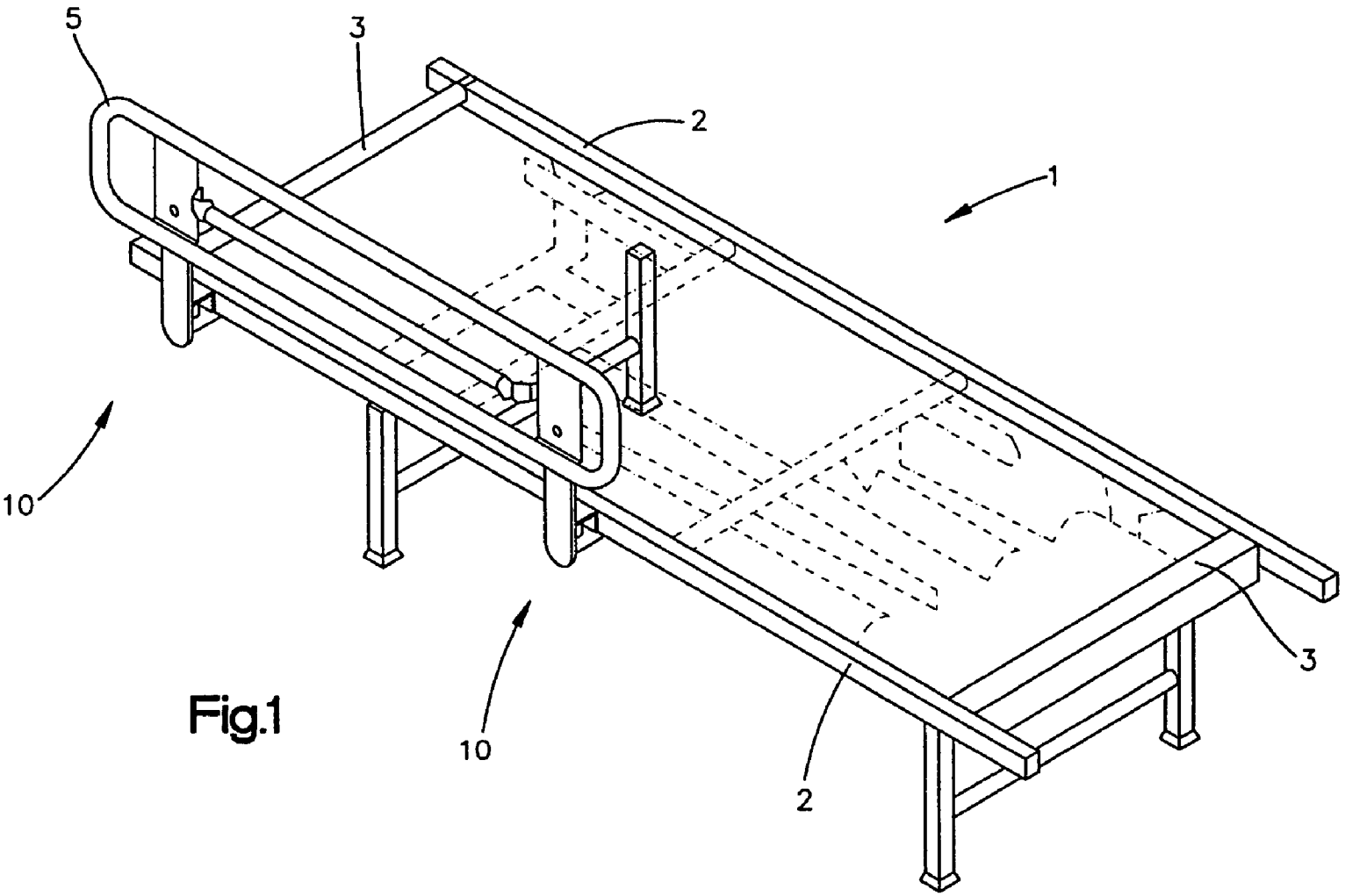
FIG. 1 is a schematic perspective view of a bed of the present invention comprising an anti-rattle mechanism.
Figure 2:
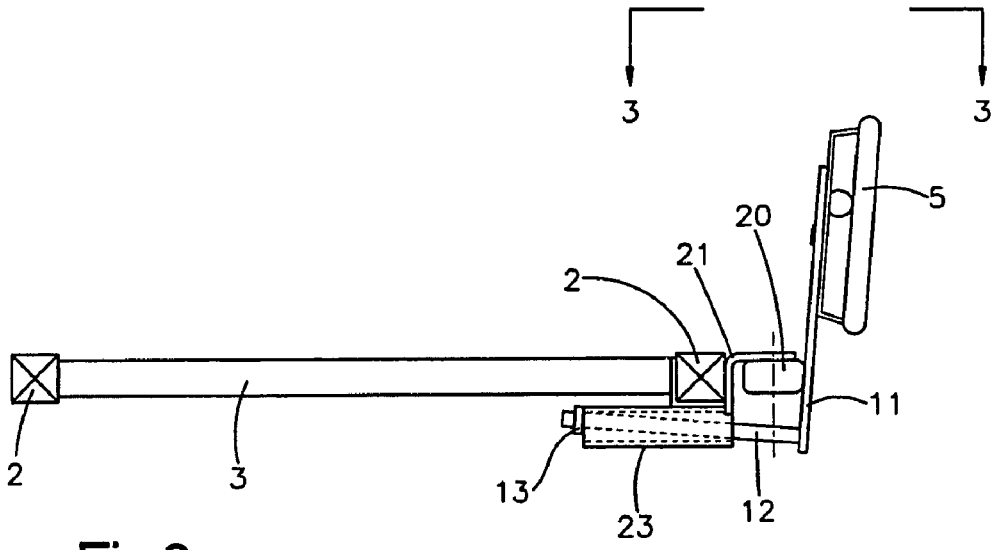
FIG. 2 is an end view of the bed of FIG. 1 showing a close-up of the anti-rattle mechanism.
Figure 3:
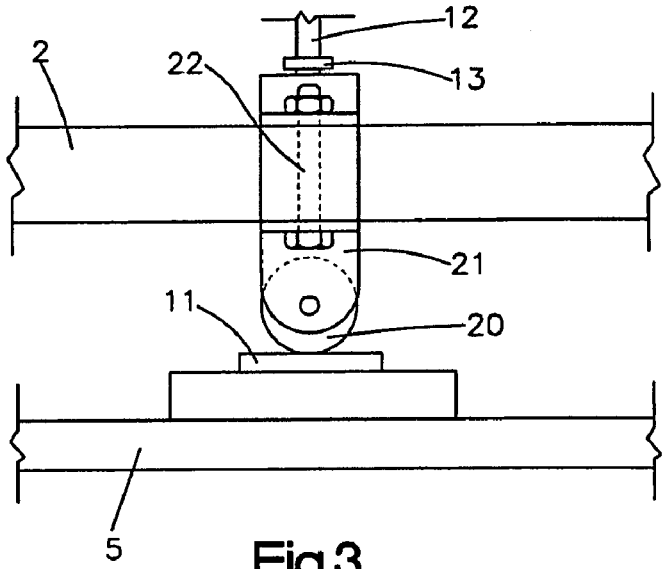
FIG. 3 is a top view of the bed of FIG. 1 showing a close-up of the anti-rattle mechanism; and, FIGS. 4*a* and 4*b* are side views of the bed of FIG. 1 showing the side rail in the open position (FIG. 4*a*) and guardrail position (FIG. 4*b*).

Referring to FIGS. 1–4, a long-term care bed comprises a frame (1) having longitudinal frame elements (2) and transverse frame elements (3). A side rail (5) is pivotally mounted on one of the longitudinal frame elements (2). Another side rail may be likewise mounted on the other longitudinal frame element. The side rail (5) has two rail support structures (10), each rail support structure comprising a rail leg (11) and a rail arm (12). The rail arm (12) is journaled in an arm holder (23) mounted to the longitudinal frame element (2) by a mounting bracket (21). The rail arm (12) is equipped with a collar (13) to prevent the rail arm (12) from slipping out of the arm holder (23). The mounting bracket (21) has a generally U-shaped portion that fits on the longitudinal frame element (2) and is held in place by a bolt (22) through the longitudinal frame element (2). Mounted on the mounting bracket (21) is a resilient roller (20) which can rotate in a plane parallel to the plane of the bed and orthogonal to the plane in which the side rail (5) pivots. The resilient roller (20) fills the distance between the longitudinal frame element (2) and the rail leg (11) as best seen in FIGS. 2 and 3. FIG. 1 shows other features of the bed in phantom lines for context while permitting the features described above to be more clearly seen.

Figure 4A:
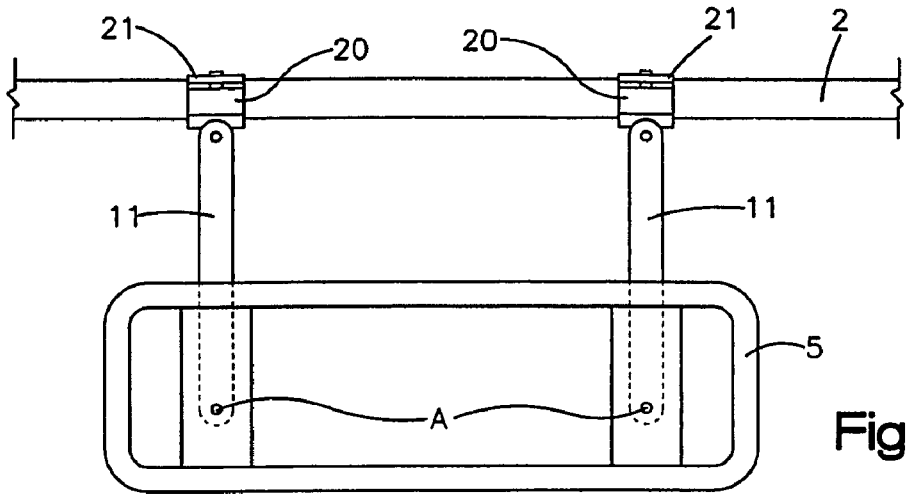
Figure 4B:
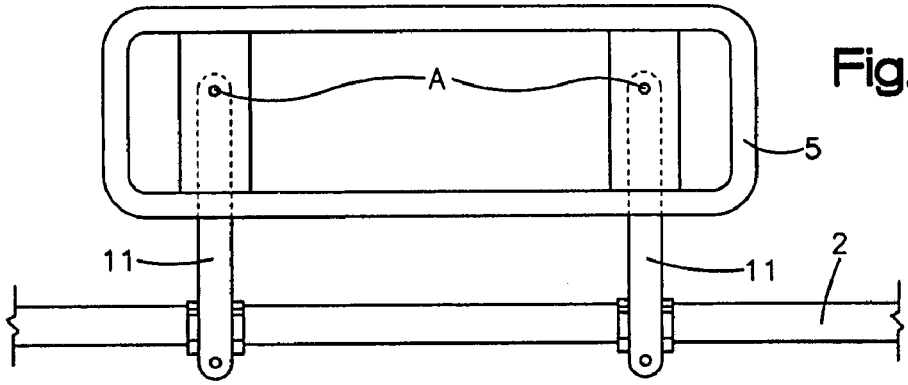

The side rail (5) can pivot between a guardrail position and an open position. As shown in FIG. 4*a*, when the side rail (5) is in the open position, it is located below the plane of the bed. In the open position, the side rail (5) is tucked under the bed to be out of the way of an attendant at the side of the bed and out of the way of a person trying to exit the bed. To rotate the side rail (5) to the guardrail position, it is first necessary to pull the side rail (5) out from under the bed. This is possible since the rail arm (12) is journaled in the arm holder (23) and is free to move in a lateral or transverse direction. The collar (13) prevents the rail arm (12) from slipping out of the arm holder (23). Once the side rail (5) has been pulled out from under the bed, the side rail (5) may be pivoted to the guardrail position by pivoting the side rail (5) in a plane parallel to the side of the bed and perpendicular to the floor, such guardrail position being shown in FIG. 4*b*. Pivoting of the side rail (5) is possible since the rail arm (12) is journaled in the arm holder (23) and the outer diameter of the rail arm (12) is smaller than the inner diameter of the arm holder (23). Thus, the rail arm (12) acts as a pivot pin for the side rail (5). Since there are two support structures (10) per side rail (5), the side rail (5) pivots on two rail arms (12). In addition, the rail pivots at points (A) on the rail legs (11). Movement of the side rail (5) from the guardrail position to the open position follows the reverse steps.

While the difference in the outer diameter of the rail arm (12) and the inner diameter of the arm holder (23) (i.e. the tolerance) permits both the transverse movement and pivoting of the side rail (5), this tolerance also leads to rattling of the side rail (5) when the side rail (5) is in the guardrail position. To reduce rattling, an anti-rattle mechanism is used. Operation of the anti-rattle mechanism will now be explained.

When the side rail (5) is in the open position, the rail legs (11) are roughly vertically oriented and point downward. When the side rail (5) is pivoted from the open position to the guardrail position, the rail legs (11) describe an arc of a circle having a center at the point where the rail arms (12) meet the rail legs (11). As a rail leg (11) begins to reach the vertically oriented upwardly pointing position, the rail leg (11) engages the resilient roller (20). The resilient roller (20) is positioned so that it would fill a little more than the distance between the longitudinal frame element (2) and the rail leg (11) when the side rail (5) is in the guardrail position. As the rail leg (11) engages the resilient roller (20), the resilient roller (20) begins to rotate and is deformed due to compression by the rail leg (11). Rotation of the resilient roller (20) permits the rail leg (11) to completely pivot to the vertically oriented upwardly pointing position. In the guardrail position, the deformed resilient roller (20) exerts a horizontal force on the rail leg (11) which tips the side rail (5) slightly away from the vertical, as best seen in FIG. 2. As a result, the rail arm (12) is tipped slightly away from the horizontal and becomes wedged in the arm holder (23) thereby reducing rattling arising from the difference in diameters of the rail arm (12) and arm holder (23). Although the rail arm (12) is wedged in the arm holder (23) to reduce rattling, the rail arm (12) is still able to pivot about the rail arm's longitudinal axis, thus, the side rail (5) can be pivoted from the guardrail position to the open position without jamming.

Figure 5:
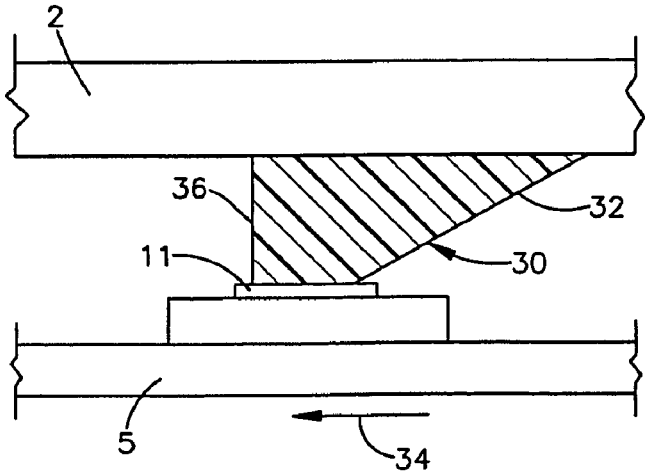
FIG. 5 is a schematic view similar to FIG. 3 showing a wedge-shaped resilient element in accordance with another embodiment of the invention.

In another embodiment, the resilient element is wedge-shaped. As shown schematically in FIG. 5, a resilient wedge 30 is mounted to the frame 2. The thin edge 32 of the wedge 30 is the leading edge in respect of the rotation of the rail 11. As the rail 11 is pivoted into the guardrail position (shown in FIG. 5) by movement in the direction illustrated by the arrow 34, the thin edge 32 of the wedge 30 is the first part of the wedge-shaped resilient element that occupies the distance between the rail and the frame 2. Once the rail 11 is completely in the guardrail position, the large edge 36 of the wedge 30 is directly between the frame 2 and the rail taking up the full distance and wedging the rail in place so that rattling of the rail is reduced. The large edge 36 of the wedge 30 is slightly larger than the distance so that the wedge is compressed between the rail 11 and the frame 2 when the rail is in the guardrail position.

Other advantages which are inherent to the structure are obvious to one skilled in the art.

The embodiments are described herein illustratively and are not meant to limit the scope of the invention as claimed.

Variations of the foregoing embodiments will be evident to a person of ordinary skill and are intended by the inventor to be encompassed by the following claims.

What is claimed is:

1. A bed comprising a frame, a rail pivotally mounted on the frame and pivotable between a guardrail position and an open position, a distance between the frame and the rail when the rail is in the guardrail position, and a resilient element mounted on the frame or on the rail or on both the frame and the rail to fill the distance between the frame and the rail when the rail is in the guardrail position to thereby reduce rattling of the rail when the rail is in the guardrail position;

wherein the resilient element is compressed between the frame and the rail when the rail is in the guardrail position: and wherein the resilient element is a resilient roller which can rotate when engaged by the rail as the rail pivots between the guardrail and open position.

2. A bed comprising a frame, a rail pivotally mounted on the frame and pivotable between a guardrail position and an open position, a distance between the frame and the rail when the rail is in the guardrail position, and a resilient roller mounted on the frame to fill the distance between the frame and the rail when the rail is in the guardrail position to thereby minimize rattling of the rail when the rail is in the guardrail position.

3. The bed according to claim 2, wherein the rail is pivotally mounted on the frame at two points.

4. The bed according to claim 3, wherein the rail comprises two rail support structures mounted on the rail, the rail is pivotally mounted on the frame at each of the rail support structures.

5. The bed according to claim 4, wherein there are two resilient rollers.

6. The bed according to claim 5, wherein each rail support structure comprises a rail arm and the rail is pivotally mounted on the frame at each of the rail arms.

7. The bed according to claim 6, wherein each rail arm is pivotally journaled in an arm holder mounted on the frame.

8. The bed according to claim 7, wherein each rail arm comprises a collar for preventing the rail arm from slipping out of the arm holder.

9. The bed according to claim 8, wherein the resilient rollers and the arm holders are mounted on the frame by mounting brackets.

10. The bed according to claim 9, wherein the resilient roller is made of natural or synthetic rubber.

11. The bed according to claim 10, wherein the bed is a hospital or long-term care bed.

12. A bed comprising:

a frame, a rail pivotally mounted on the frame and pivotable between a guardrail position and an open position; and a resilient element mounted on the rail for movement with the rail between the guardrail position and the open position and engageable with the frame when the guardrail is in the guardrail position to thereby reduce rattling of the rail when the rail is in the guardrail position;

wherein the resilient element is a roller which can rotate when engaged by the frame as the rail pivots between the guardrail and open position.

13. A bed comprising:

a frame;

a rail pivotally mounted on the frame and pivotable between a guardrail position and an open position;

a distance between the frame and the rail when the rail is in the guardrail position, and a resilient element on the frame or on the rail or on both that in a free state is somewhat larger than the distance between the frame and the rail but that is sufficiently deformable from the free state to be forced to fit into the distance when the guardrail moves into the guardrail position;

wherein the resilient element is a roller.

* * * * *